US008690612B2

(12) United States Patent
Tomanek et al.

(10) Patent No.: US 8,690,612 B2
(45) Date of Patent: Apr. 8, 2014

(54) ELECTRICAL CONNECTORS AND METHODS FOR COUPLING THE ELECTRICAL CONNECTORS TO BUSBARS

(75) Inventors: Tomasz Pawel Tomanek, Slaskie (PL); Johan Rene Sylvain De Cuyper, Ooost Vlaanderen (BE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/430,335

(22) Filed: Mar. 26, 2012

(65) Prior Publication Data

US 2013/0171888 A1 Jul. 4, 2013

Related U.S. Application Data

(63) Continuation-in-part of application No. 13/338,473, filed on Dec. 28, 2011.

(51) Int. Cl.
*H01R 11/03* (2006.01)

(52) U.S. Cl.
USPC ..... 439/793; 439/213

(58) Field of Classification Search
USPC ..... 439/791–793, 806, 801, 213, 212
See application file for complete search history.

(56) References Cited

U.S. PATENT DOCUMENTS

| | | | | | |
|---|---|---|---|---|---|
| 905,773 | A | * | 12/1908 | Vibber | 439/792 |
| 1,663,005 | A | * | 3/1928 | Hendee | 439/792 |
| 2,083,606 | A | * | 6/1937 | Johansson | 439/791 |
| 2,097,324 | A | | 10/1937 | Hill | |
| 2,136,366 | A | | 11/1938 | Martin | |
| 2,357,171 | A | | 8/1944 | Carlson | |
| 2,574,781 | A | | 11/1951 | Greene et al. | |
| 2,651,767 | A | | 9/1953 | Bergan | |
| 3,041,574 | A | * | 6/1962 | Cornell, Jr. | 439/277 |
| 3,798,585 | A | * | 3/1974 | Thompson et al. | 439/98 |
| 3,985,411 | A | * | 10/1976 | Mooney et al. | 439/791 |
| 4,722,703 | A | | 2/1988 | Hufnagl | |
| 4,784,621 | A | * | 11/1988 | Auclair | 439/793 |
| 4,849,581 | A | | 7/1989 | Larkin et al. | |
| 4,859,193 | A | | 8/1989 | Pfannkuche et al. | |
| 4,875,876 | A | * | 10/1989 | O'Loughlin | 439/431 |
| 4,950,841 | A | | 8/1990 | Walker et al. | |
| 4,966,563 | A | | 10/1990 | Pierce et al. | |
| 5,114,354 | A | * | 5/1992 | Franks, Jr. | 439/92 |

(Continued)

FOREIGN PATENT DOCUMENTS

| | | | |
|---|---|---|---|
| DE | 3330984 | A1 | 3/1985 |
| DE | 4124066 | A1 | 1/1993 |
| DE | 19731858 | A1 | 1/1999 |
| DE | 29816627 | U1 | 1/1999 |

(Continued)

OTHER PUBLICATIONS

Search Report and Written Opinion from EP Application No. 12197433.1 dated Apr. 3, 2013.

(Continued)

*Primary Examiner* — Gary Paumen
(74) *Attorney, Agent, or Firm* — Cantor Colburn LLP

(57) ABSTRACT

An electrical connector is provided. The electrical connector includes a first mounting portion. The electrical connector further includes a first clamping portion coupled to the first mounting portion. The first clamping portion has a first coupling tab and a second coupling tab. The first and second coupling tabs define a first gap. The first and second coupling tabs are configured to form an electrical connection with the first busbar in the first gap.

12 Claims, 18 Drawing Sheets

(56) References Cited

U.S. PATENT DOCUMENTS

| | | | |
|---|---|---|---|
| 5,783,779 | A | 7/1998 | Graham et al. |
| 5,821,464 | A | 10/1998 | Graham et al. |
| 5,934,818 | A | 8/1999 | Schmitt et al. |
| 6,224,433 | B1 | 5/2001 | Chadbourne et al. |
| 6,471,553 | B2 | 10/2002 | Kasai |
| 6,855,012 | B2 | 2/2005 | An |
| 7,410,385 | B2 | 8/2008 | Buttner |
| 7,775,818 | B2 | 8/2010 | Listl et al. |

FOREIGN PATENT DOCUMENTS

| | | | |
|---|---|---|---|
| EP | 0234735 | A1 | 9/1987 |
| EP | 1014494 | A1 | 6/2000 |
| EP | 1345284 | A2 | 9/2003 |

OTHER PUBLICATIONS

Search Report regarding EP Application No. 13160765.7-1801 dated Aug. 1, 2013, 5 pgs.

* cited by examiner

ELECTRICAL CONNECTORS AND METHODS FOR COUPLING THE ELECTRICAL CONNECTORS TO BUSBARS

CROSS-REFERENCE TO RELATED APPLICATIONS

This application is a continuation-in-part of pending U.S. patent application Ser. No. 13/338,473, filed on Dec. 28, 2011 that is incorporated by reference herein in its entirety.

BACKGROUND OF THE INVENTION

Electrical busbars, such as elongated rectangular flat conductive bus bars, have long been utilized in the electrical distribution industry to conduct electricity. Two electrical busbars have been conventionally connected together by drilling or otherwise forming holes through the two electrical busbars and coupling the busbars together utilizing bolts disposed through the holes. The drilling process, however, is a labor intensive and time consuming task. Additionally, the need for bolts adds cost and labor for installation.

Accordingly, the inventors herein have recognized a need for improved electrical connectors.

BRIEF DESCRIPTION OF THE INVENTION

An electrical connector in accordance with an exemplary embodiment is provided. The electrical connector includes a first mounting portion. The electrical connector further includes a first clamping portion coupled to the first mounting portion. The first clamping portion has a first coupling tab and a second coupling tab. The first coupling tab extends from the first mounting portion in a first direction. The first coupling tab has first and second apertures extending therethrough. The second coupling tab extends from the first mounting portion in the first direction. The first and second coupling tabs define a first gap. The second coupling tab has third and fourth apertures extending therethrough. The third and fourth apertures are aligned with the first and second apertures, respectively. The first and third apertures are configured to receive a first fastener. The second and fourth apertures are configured to receive a second fastener. The first gap is sized to receive a first busbar. The first and second coupling tabs are configured to form an electrical connection with the first busbar in the first gap.

A method for manufacturing a plurality of connector portions of electrical connectors in accordance with another exemplary embodiment is provided. The method includes moving a liquid metal through an extruding die to form an extruded portion having a cross-sectional profile corresponding to a connector portion. The method further includes cooling the extruded portion utilizing a cooling device. The method further includes cutting the extruded portion into the plurality of connector portions utilizing a cutting device. Each connector portion has a mounting portion and a clamping portion. Each clamping portion has first and second coupling tabs that extend from a respective mounting portion.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
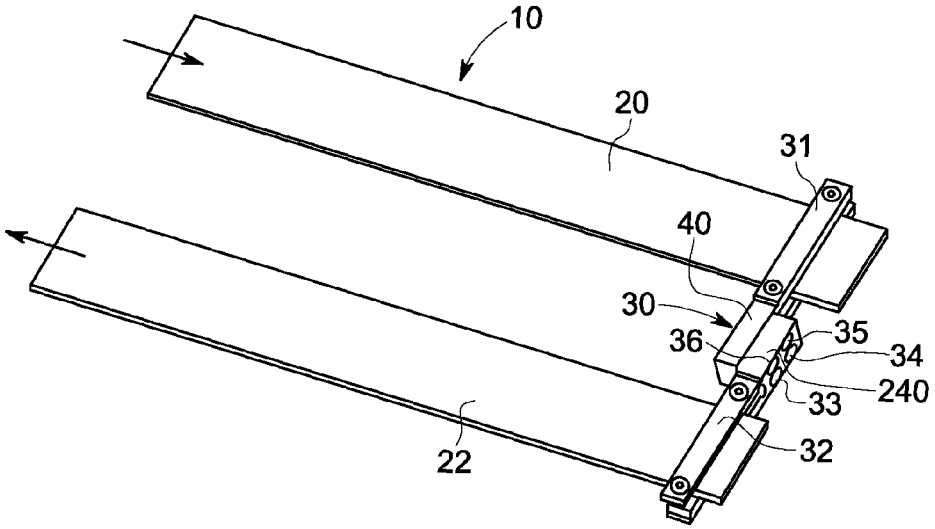
FIG. 1 is a schematic of an electrical circuit having an electrical connector in accordance with an exemplary embodiment.
Figure 2:
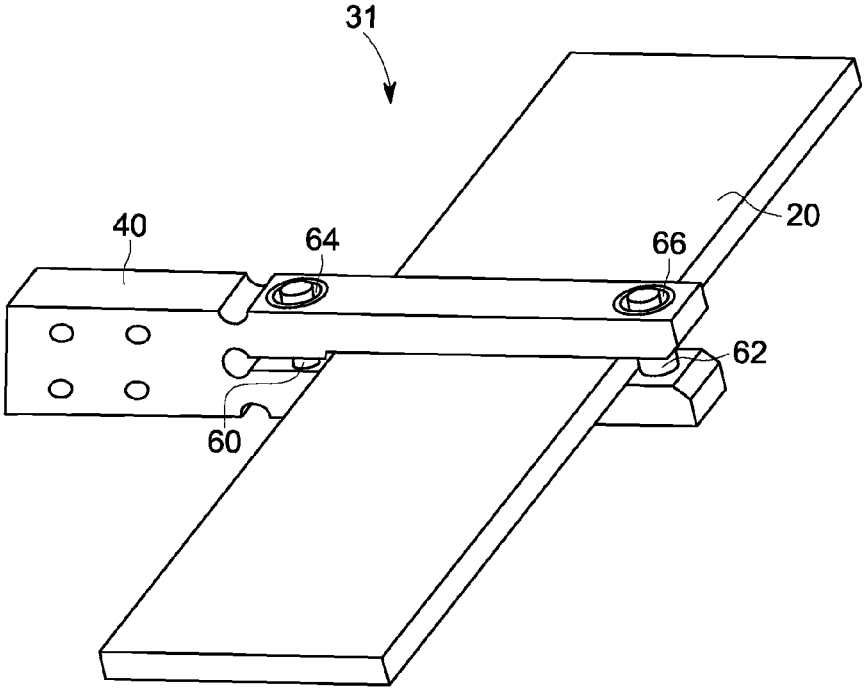
FIG. 2 is a schematic of a first connector portion of the electrical connector of FIG. 1.
Figure 3:
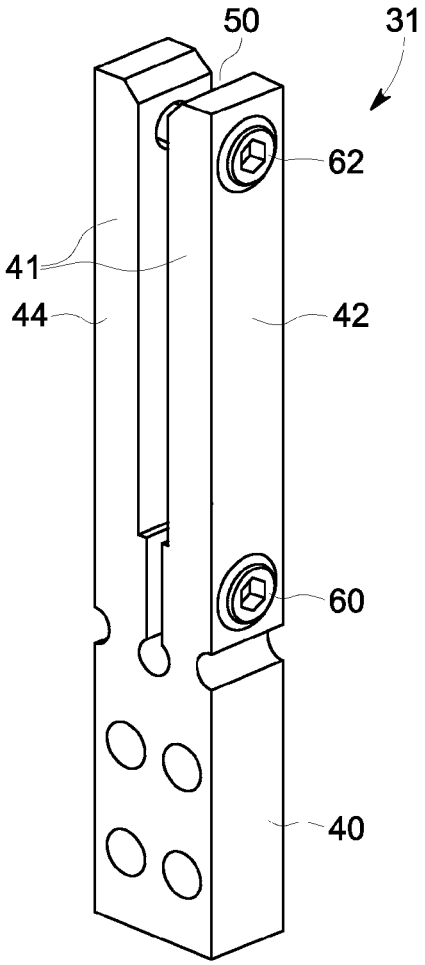
FIG. 3 is another schematic of the first connector portion of the electrical connector of FIG. 1.
Figure 4:
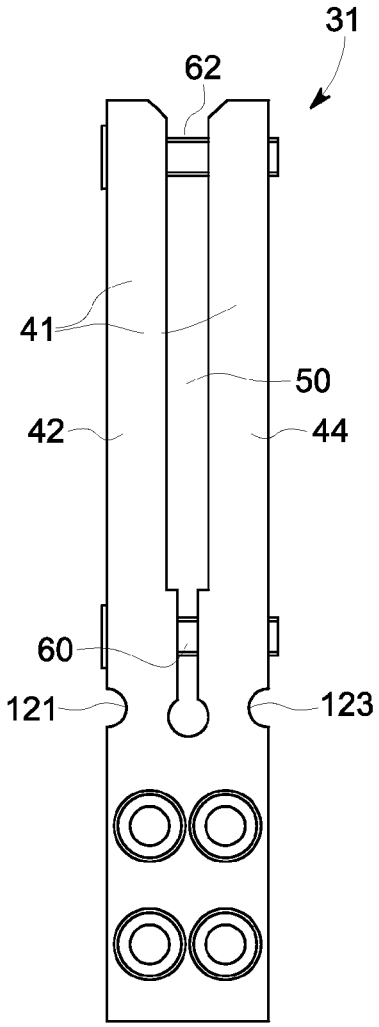
FIG. 4 is a side view of the first connector portion of FIG. 3.

Referring to FIGS. 1-3, an electrical circuit 10 having a first busbar 20, a second busbar 22, and an electrical connector 30 in accordance with an exemplary embodiment is illustrated. An advantage of the electrical connector 30 is that the connector 30 is coupled to the first busbar 20 and the second busbar 22 without drilling holes in the busbars 20, 22.

The first busbar 20 and the second busbar 22 are each constructed of an electrically conductive material for conducting electricity therethrough. In one exemplary embodiment, the first busbar 20 and the second busbar 22 are constructed of copper.

The electrical connector 30 includes a first connector portion 31, a second connector portion 32, and fasteners such as bolts 33, 34, 35, 36 for example. The first connector portion 31 is coupled to the second connector portion 32 utilizing the bolts 33, 34, 35, 36.

Referring to FIGS. 1, 3-5, and 27, the first connector portion 31 is configured to be coupled to the second connector portion 32 and to the busbar 20. The first connector portion 31 includes a mounting portion 40; a clamping portion 41 having coupling tabs 42, 44; fasteners such as bolts 60, 62; and nuts 64, 66. The mounting portion 40 may be block-shaped and includes apertures 80, 82, 84, 86 extending therein. In one exemplary embodiment, the block-shaped mounting portion 40 is parallelepiped shaped. The mounting portion 40 is constructed of an electrically conductive material. In one exemplary embodiment, the mounting portion 40 is constructed of copper. Of course, in an alternative embodiment, the mounting portion 40 could be constructed of another electrically conductive material suitable for a purpose disclosed herein.

Figure 5:
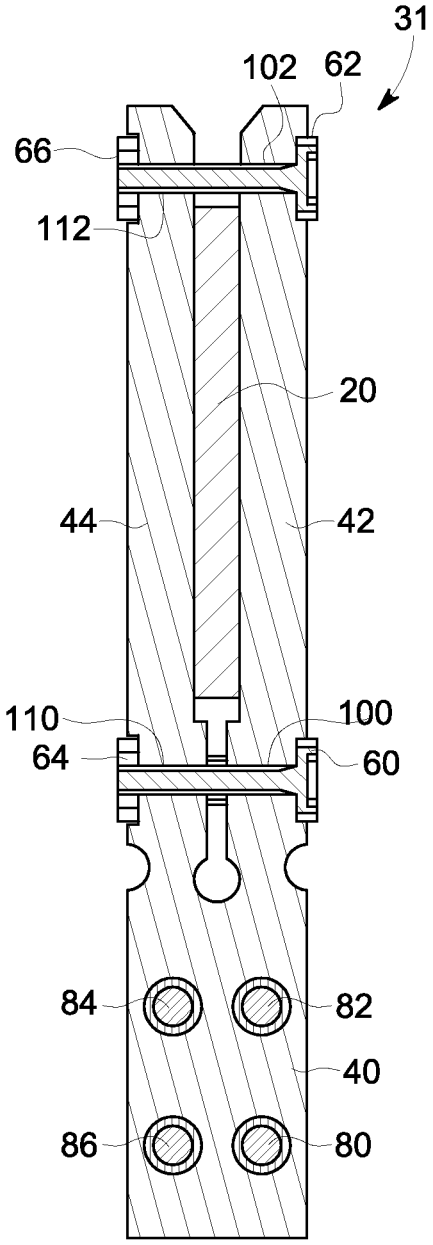
FIG. 5 is a cross-sectional view of the first connector portion of FIG. 3.
Figure 6:
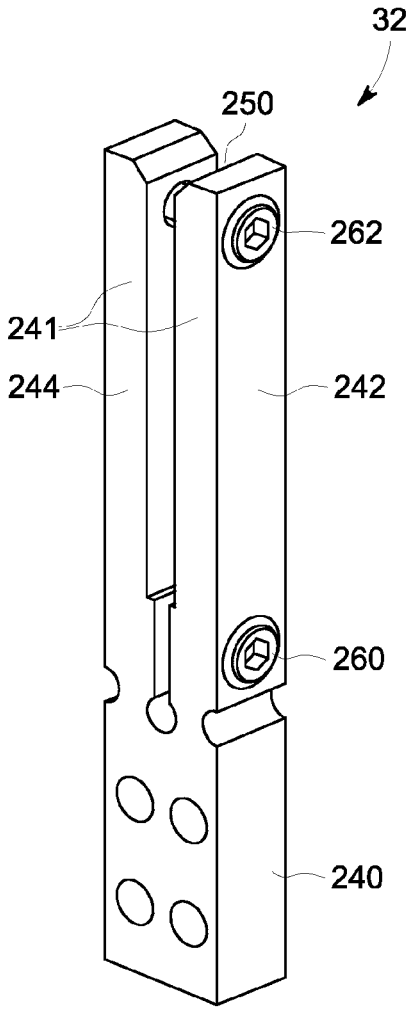
FIG. 6 is a schematic of a second connector portion of the electrical connector of FIG. 1.
Figure 7:
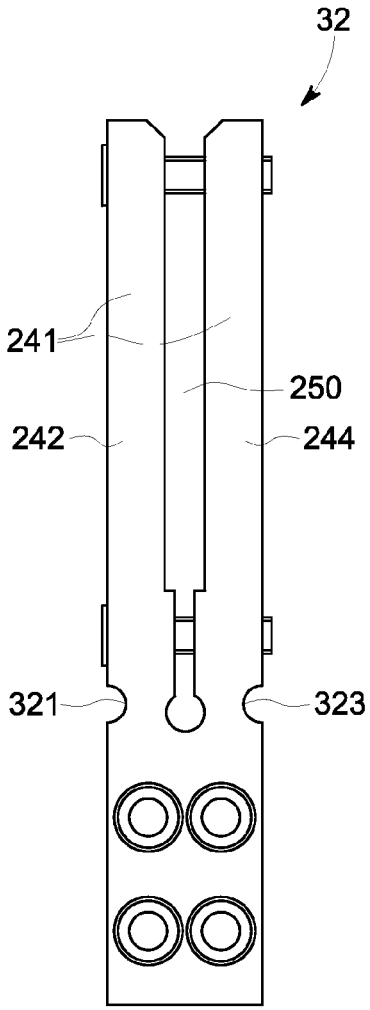
FIG. 7 is a side view of the second connector portion of FIG. 6.
Figure 8:
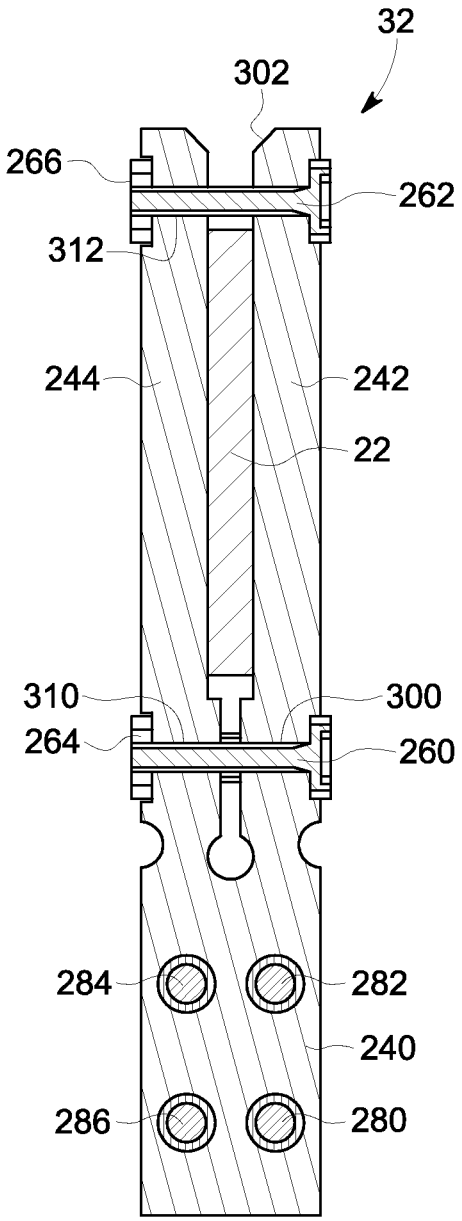
FIG. 8 is a cross-sectional view of the second connector portion of FIG. 6.

Referring to FIGS. 3 and 5, the clamping portion 41 having coupling tabs 42, 44 is configured to hold the busbar 20 between the coupling tabs 42, 44. The coupling tab 42 extends from the mounting portion 40 in a first direction. The coupling tab 42 has apertures 100, 102 extending therethrough. The coupling tab 44 extends from the mounting portion 40 in the first direction such that a gap 50 is formed between the coupling tabs 42, 44. The gap 50 has a size sufficient to receive an end portion of the busbar 20 therein. The coupling tab 44 has apertures 110, 112 extending therethrough. The apertures 110, 112 in the coupling tab 44 are aligned with the apertures 100, 102 respectively in the coupling tab 42. The coupling tabs 42, 44 have grooves 121, 123, respectively, disposed proximate to the mounting portion 40, wherein the coupling tabs 42, 44 are bendable proximate the grooves 121, 123, respectively, toward one another. The coupling tabs 42, 44 are each constructed of an electrically conductive material. In one exemplary embodiment, coupling tabs 42, 44 are constructed of copper. Of course, in an alternative embodiment, the coupling tabs 42, 44 could each be constructed of another electrically conductive material suitable for a purpose disclosed herein.

The bolt 60 is configured to be disposed through the apertures 100, 110 and is coupled to the nut 64. The bolt 62 is configured to be disposed through the apertures 102, 112 and is coupled to the nut 66. When bolts 60, 62 are tightened within the nuts 64, 66, respectively, the coupling tabs 42, 44 are urged towards one another such that the coupling tabs 42, 44 are fixedly clamped against the first busbar 20 disposed through the gap 50 between the coupling tabs 42, 44. Also, the mounting portion 40 is electrically coupled to the first busbar 20 via the coupling tabs 42, 44.

Referring to FIGS. 6-9, the second connector portion 32 is configured to be coupled to the first connector portion 31 and to the busbar 22. The second connector portion 32 includes a mounting portion 240; a clamping portion 241 having coupling tabs 242, 244; fasteners such as bolts 260, 262; and nuts 264, 266. The mounting portion 240 may be block-shaped and includes apertures 280, 282, 284, 286 extending therein. In one exemplary embodiment, the block-shaped mounting portion 240 is parallelepiped shaped. The mounting portion 240 is constructed of an electrically conductive material. In one exemplary embodiment, the mounting portion 240 is constructed of copper. Of course, in an alternative embodiment, the mounting portion 240 could be constructed of another electrically conductive material suitable for a purpose disclosed herein.

The clamping portion 241 having coupling tabs 242, 244 is configured to hold the busbar 22 between the coupling tabs 242, 244. The coupling tab 242 extends from the mounting portion 240 in a first direction. The coupling tab 242 has apertures 300, 302 extending therethrough. The coupling tab 244 extends from the mounting portion 240 in the first direction such that a gap 250 is formed between the coupling tabs 242, 244. The gap 250 has a size sufficient to receive the busbar 22 therein. The coupling tab 244 has apertures 310, 312 extending therethrough. The apertures 310, 312 in the coupling tab 244 are aligned with the apertures 300, 302 respectively in the coupling tab 242. The coupling tabs 242, 244 have grooves 321, 323, respectively, disposed proximate to the mounting portion 240, wherein the coupling tabs 242, 244 are bendable proximate the grooves 321, 323, respectively, toward one another. The coupling tabs 242, 244 are each constructed of an electrically conductive material. In one exemplary embodiment, coupling tabs 242, 244 are constructed of copper. Of course, in an alternative embodiment, the coupling tabs 242, 244 could each be constructed of another electrically conductive material suitable for a purpose disclosed herein.

The bolt 260 is configured to be disposed through the apertures 300, 310 and is coupled to the nut 264. The bolt 262 is configured to be disposed through the apertures 302, 312 and is coupled to the nut 266. When bolts 260, 262 are tightened within the nuts 264, 266, respectively, the coupling tabs 242, 244 are urged towards one another such that the coupling tabs 242, 244 are fixedly clamped against the second busbar 22 disposed through the gap 250 between the coupling tabs 242, 244. Also, the mounting portion 240 is electrically coupled to the second busbar 22 via the coupling tabs 242, 244.

Figure 9:
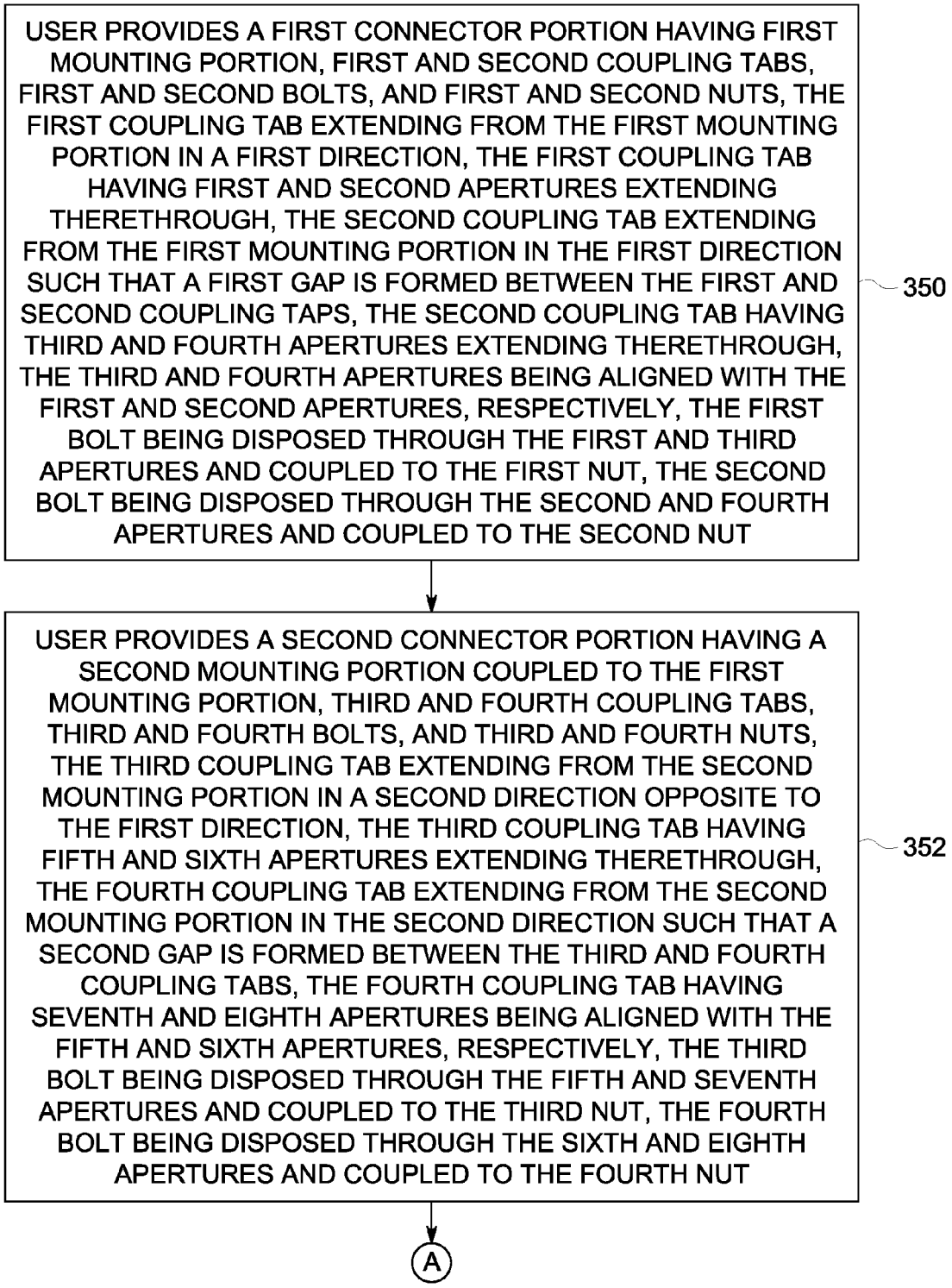
FIGS. 9 and 10 are a flowchart of a method for coupling an electrical connector to a busbar in accordance with another exemplary embodiment.
Figure 10:
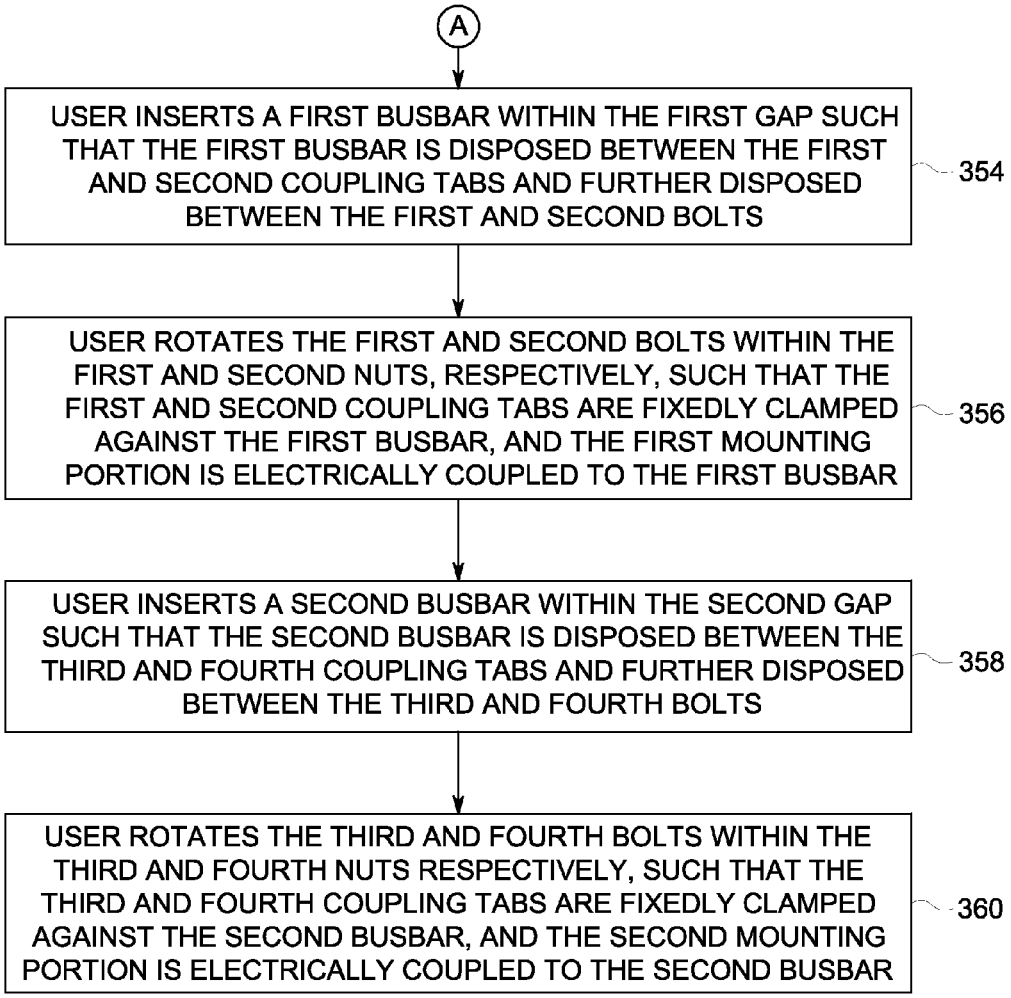

Referring to FIGS. 9 and 10, a flowchart of a method for coupling the electrical connector 30 to busbars 20, 22 in accordance with another exemplary embodiment will be explained.

At step 350, the user provides the first connector portion 31 having a mounting portion 40; the clamping portion 41 having coupling tabs 42, 44; bolts 60, 62; and nuts 64, 66. The coupling tab 42 extends from the mounting portion 40 in a first direction. The coupling tab 42 has apertures 100, 102 extending therethrough. The coupling tab 44 extends from the mounting portion 40 in the first direction such that the gap 50 is formed between the coupling tabs 42, 44. The coupling tab 44 has apertures 110, 112 extending therethrough. The apertures 110, 112 are aligned with the apertures 100, 102, respectively. The bolt 60 is disposed through the apertures 100, 110 and is coupled to the nut 64. The bolt 62 is disposed through the apertures 102, 112 and is coupled to the nut 66.

At step 352, the user provides the second connector portion 32 having a mounting portion 240; a clamping portion 241 having coupling tabs 242, 244; bolts 260, 262; and nuts 264, 266. The coupling tab 242 extends from the mounting portion 240 in a first direction. The coupling tab 242 has apertures 300, 302 extending therethrough. The coupling tab 244 extends from the mounting portion 240 in the first direction such that the gap 250 is formed between the coupling tabs 242, 244. The coupling tab 244 has apertures 310, 312 extending therethrough. The apertures 310, 312 are aligned with the apertures 300, 302, respectively. The bolt 260 is disposed through the apertures 300, 310 and it is coupled to the nut 264. The bolt 262 is disposed through the apertures 302, 312 and is coupled to the nut 266.

To form the electrical connector 30 as a combination of the first connector portion 31 and the second connector portion 32, the mounting portion 240 can be coupled to the mounting portion 40 or formed as a unitary body. The coupling tabs 242 and 244 extend from the mounting portion 240 in an opposite direction relative to the direction in which the coupling tabs 42 and 44 extend from the mounting portion 40. The mounting portion 40 is a first mounting portion, and the mounting portion 240 is a second mounting portion. The clamping portion 41 is a first clamping portion, and the clamping portion 241 is a second clamping portion. The coupling tabs 42, 44, 242, 244 are first, second, third, and fourth coupling tabs, respectively. The apertures 100, 102, 110, 112, 300, 302, 310, 312 are first, second, third, fourth, fifth, sixth, seventh, and eighth apertures, respectively. The gap 50 is a first gap, and the gap 250 is a second gap. The bolts 60, 62, 260, 262 are first, second, third, and fourth fasteners, respectively.

At step 354, the user inserts the first busbar 20 within the gap 50 such that the first busbar 20 is disposed between the coupling tabs 42, 44 and further disposed between the bolts 60, 62.

At step 356, the user rotates the bolts 60, 62 within the nuts 64, 66, respectively, such that the coupling tabs 42, 44 are fixedly clamped against the first busbar 20. Also, the mounting portion 40 is electrically coupled to the first busbar 20.

At step 358, the user inserts the second busbar 22 within the gap 250 such that the second busbar 22 is disposed between the coupling tabs 242, 244 and is further disposed between the bolts 260, 262.

At step 360, the user rotates the bolts 260, 262 within the nuts 264, 266, respectively, such that the coupling tabs 242, 244 are fixedly clamped against the second busbar 22, and the mounting portion 240 is electrically coupled to the second busbar 22.

Referring to FIGS. 19, 20, 24 and 25, a system 700 for manufacturing a plurality of connector portions of electrical connectors in accordance with another exemplary embodiment will now be explained. The system 700 includes a melting device 710, an extruding device 720, a first conveyor device 730, a cooling device 740, a second conveyor device 750, a cutting device 760, and a drilling device 770.

The melting device 710 is configured to melt a metal to form a liquid metal 712. In one exemplary embodiment, the liquid metal 712 is liquid copper.

The extruding device 720 is configured to receive the liquid metal 712 from the melting device 710 and to move the liquid metal 712 through an extruding die 724 within the extruding device 720 to form an extruded portion 726. The extruded portion 726 has a cross-sectional profile corresponding to a connector portion. The extruding die 724 is constructed of plates 780, 782, 784, 786, 788, 790 coupled together. The extruding die 724 has an inlet aperture 820 and an outlet aperture 824. The outlet aperture 824 has a profile corresponding to a connector portion such that when the liquid metal 712 exits the outlet aperture 824, the extruded portion 726 has a cross-sectional profile corresponding to a connector portion.

The first conveyor device 730 is configured to move the extruded portion 726 exiting the extruding device 720 from the extruding device 720 to the cooling device 740.

The cooling device 740 is configured to cool the extruded portion 726 such that the extruded portion 726 is solidified. In one exemplary embodiment, the cooling device 740 applies a liquid on the extruded portion 726 to cool the extruded portion 726.

The second conveyor device 750 is configured to move the extruded portion 726 from the cooling device 740 to the cutting device 760.

Figure 19:
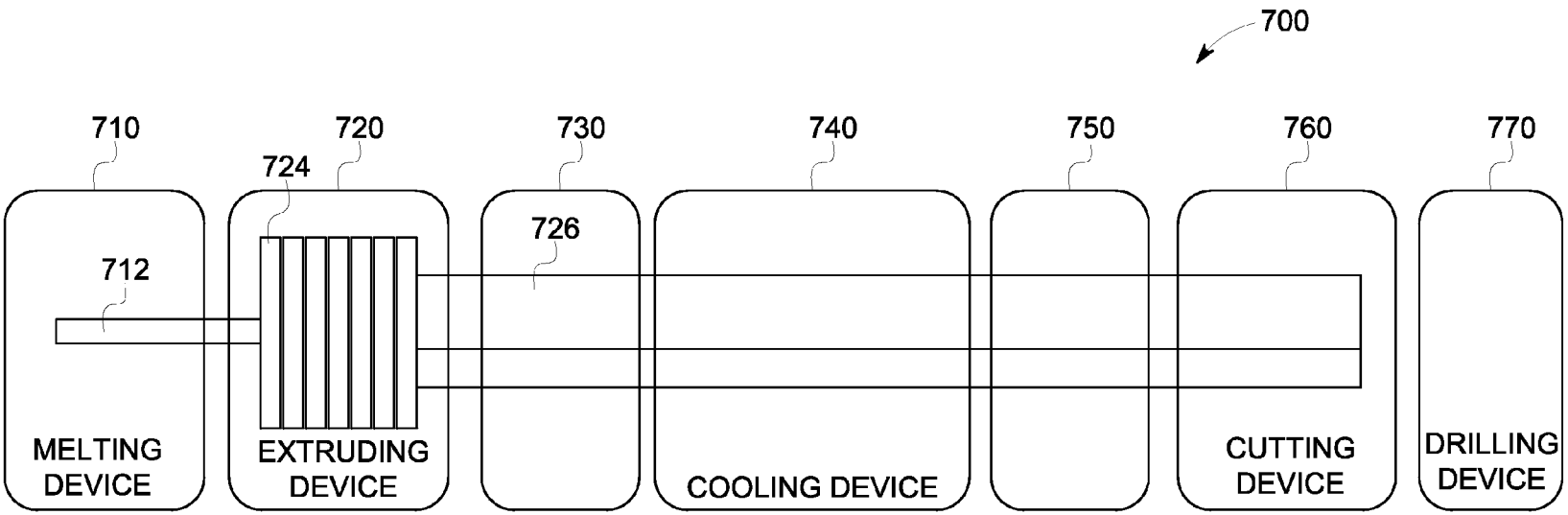
FIG. 19 is a block diagram of a system for manufacturing a plurality of connector portions of electrical connectors in accordance with another exemplary embodiment.
Figure 20:
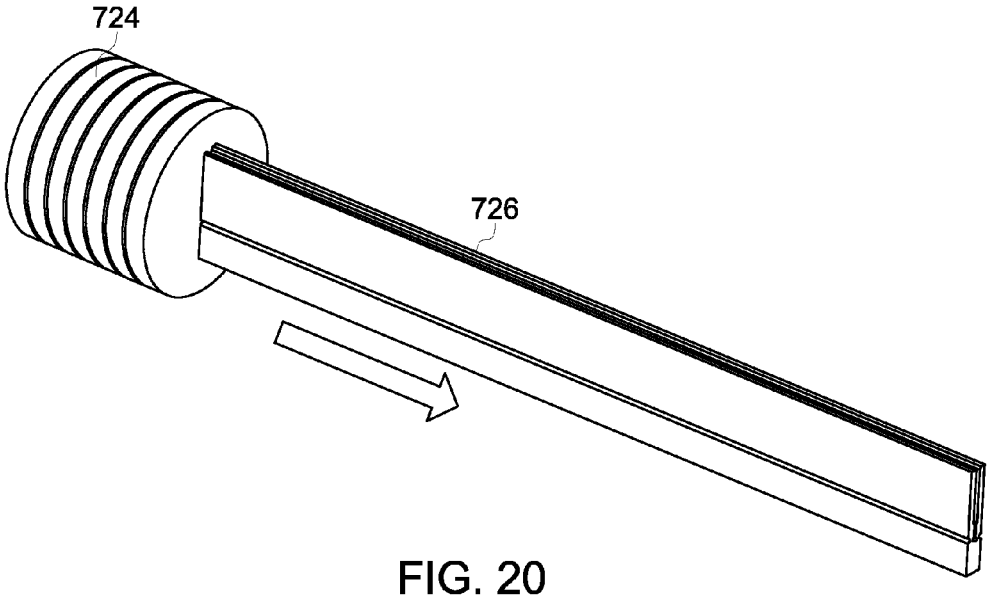
FIG. 20 is a schematic of an extruding die utilized in the system of FIG. 19 and an extruded portion exiting the extruding die.
Figure 21:
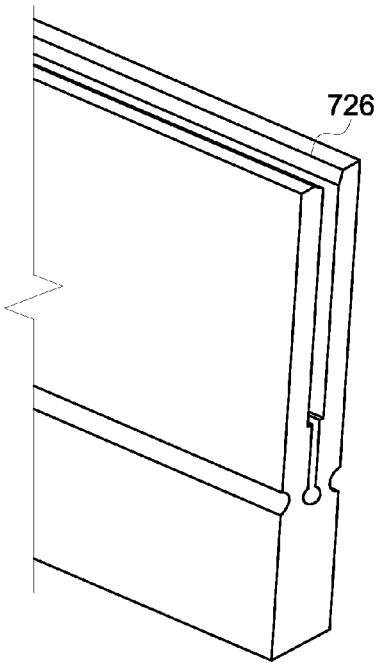
FIG. 21 is an enlarged schematic of a portion of the extruded portion of FIG. 20.
Figure 22:
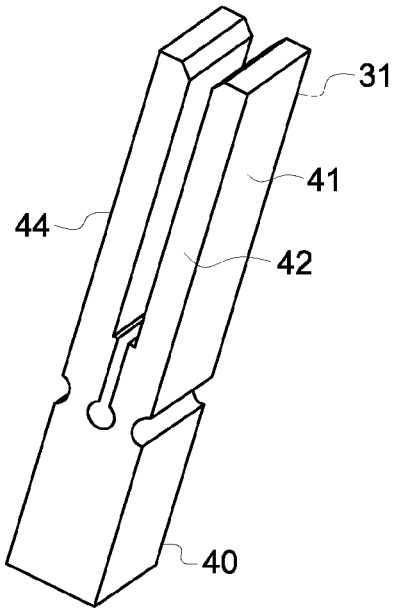
FIG. 22 is a schematic of a connector portion cut from the extruded portion of FIG. 20 prior to the apertures being drilled.
Figure 23:
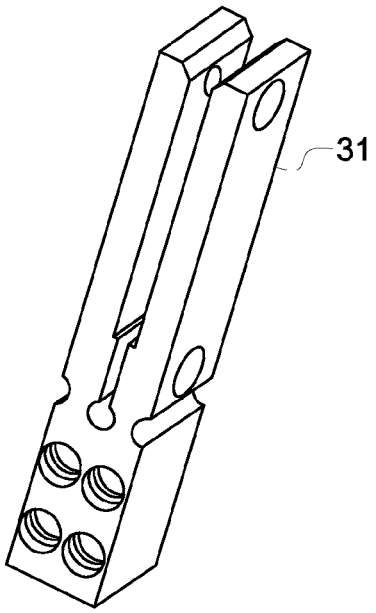
FIG. 23 is a schematic of the connector portion of FIG. 22 having apertures drilled therein.
Figure 24:
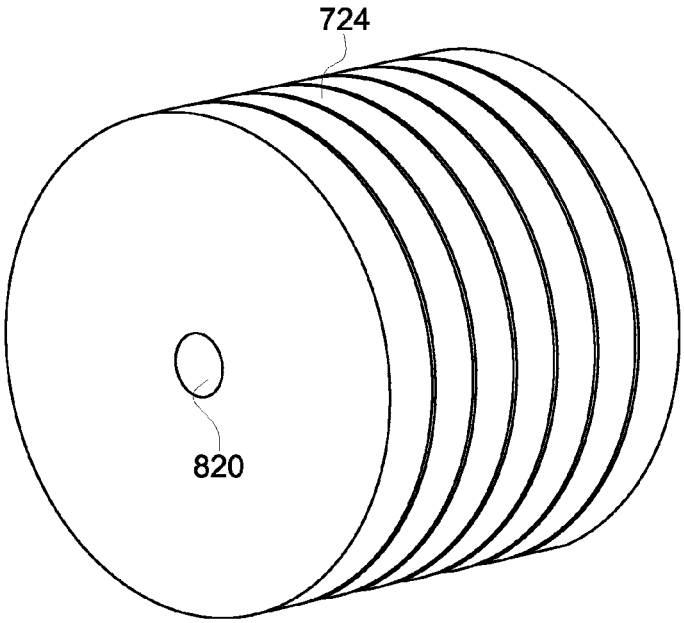
FIG. 24 is a schematic of the extruding die utilized in the system of FIG. 19.
Figure 25:
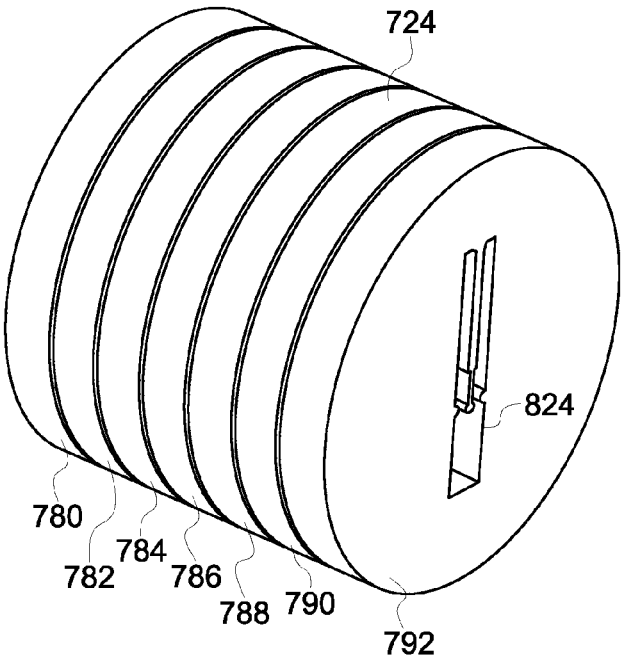
FIG. 25 is another schematic of the extruding die utilized in the system of FIG. 19.
Figure 26:
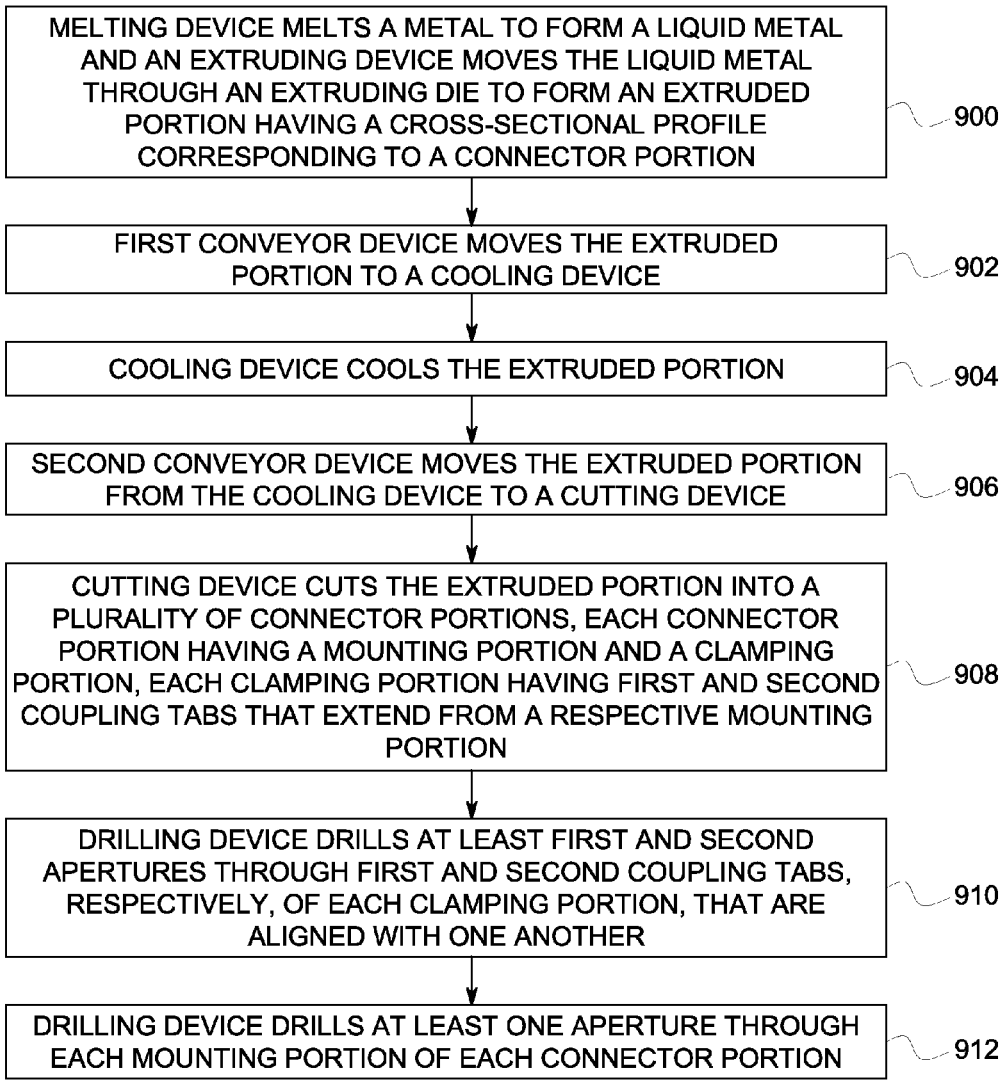
FIG. 26 is a flowchart of a method for manufacturing a plurality of connector portions of electrical connectors in accordance with another exemplary embodiment.
Figure 27:
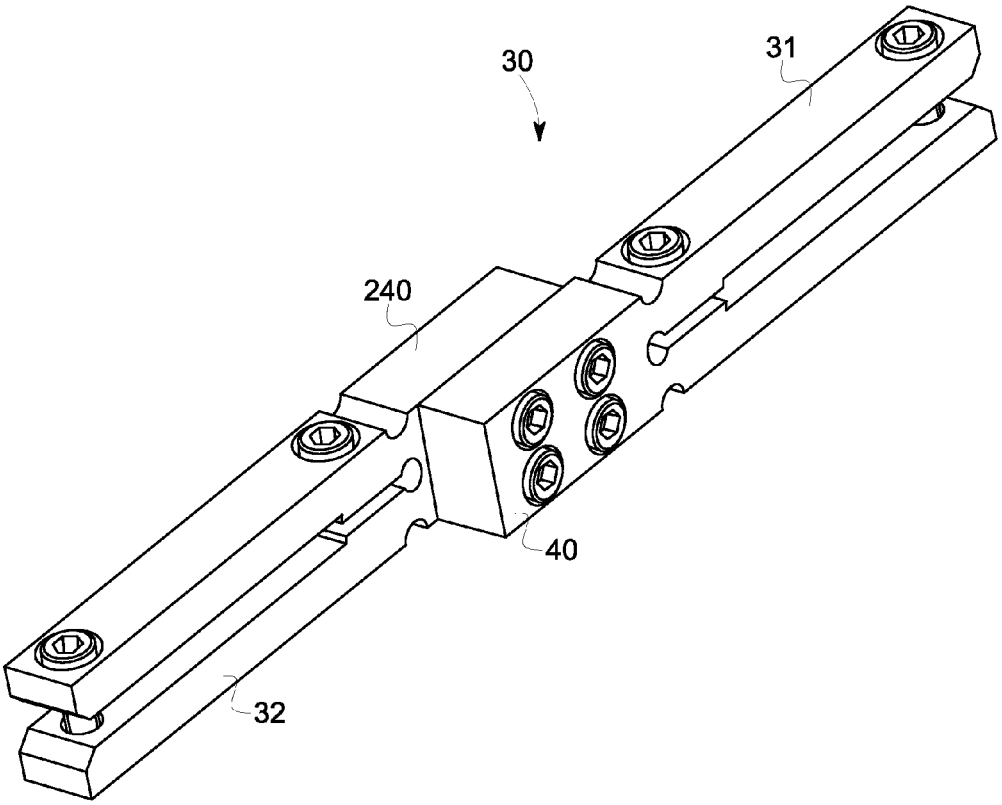
FIG. 27 is an enlarged schematic of the electrical connector of FIG. 1.

Referring to FIGS. 19, 22 and 23, the cutting device 760 cuts the extruded portion 760 into the plurality of connector portions 31. Each connector portion 31 has a mounting portion 40 and a clamping portion 41. Each clamping portion 41 has first and second coupling tabs 42, 44 that extend from a respective mounting portion 40.

Referring to FIGS. 5 and 19, the drilling device 770 drills apertures 100, 102 in the coupling tab 42 and apertures 110, 112 in the coupling tab 44. The apertures 100, 110 are aligned with one another, and the apertures 102, 112 are aligned with one another.

Referring to FIGS. 5, 19 and 23, the drilling device 770 drills the apertures 80, 82, 84, 86 through each mounting portion 40 of each connector portion 31.

Referring to FIGS. 5, 19, 20, 24 and 25, a flowchart of a method for manufacturing a plurality of connector portions of electrical connectors in accordance with another exemplary embodiment will now be explained.

At step 900, the melting device 710 melts a metal to form a liquid metal 712 and the extruding device 720 moves the liquid metal 712 through the extruding die 720 to form the extruded portion 726 having a cross-sectional profile corresponding to a connector portion 31.

At step 902, the first conveyor device 730 moves the extruded portion 726 to the cooling device 740.

At step 904, the cooling device 740 cools the extruded portion 726.

At step 906, the second conveyor device 750 moves the extruded portion 726 from the cooling device 740 to the cutting device 760.

At step 908, the cutting device 760 cuts the extruded portion 726 into the plurality of connector portions 31. Each connector portion 31 has a mounting portion 40 and a clamping portion 41. Each clamping portion 41 has first and second coupling tabs 42, 44 that extend from a respective mounting portion 40.

At step 910, the drilling device 770 drills at least first and second apertures 100, 110 in the first and second coupling tabs 42, 44, respectively, of each clamping portion 41, that are aligned with one another.

At step 912, the drilling device 770 drills at least one aperture 80 through each mounting portion 40 of each connector portion 31.

Figure 11:
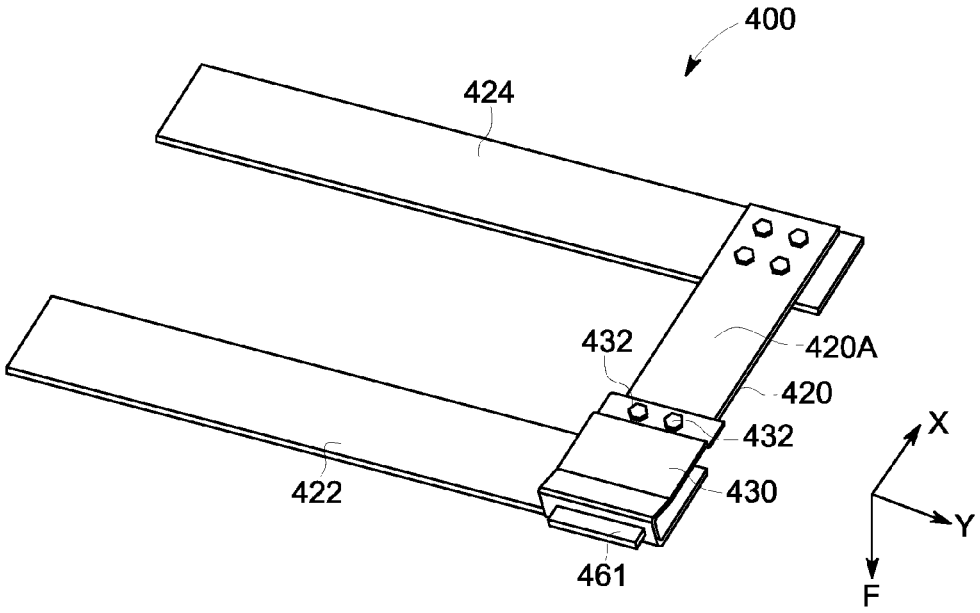
FIG. 11 is a schematic of an electrical circuit having an electrical connector in accordance with an exemplary embodiment.
Figure 12:
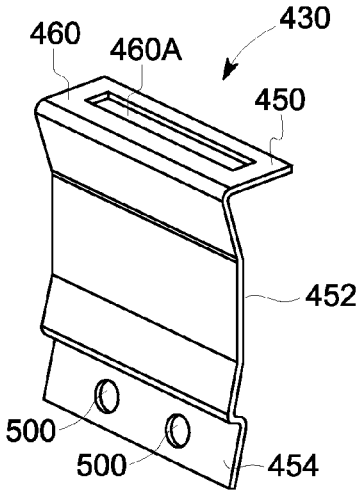
FIG. 12 is a schematic of the electrical connector of FIG. 11 in accordance with an exemplary embodiment.
Figure 15:
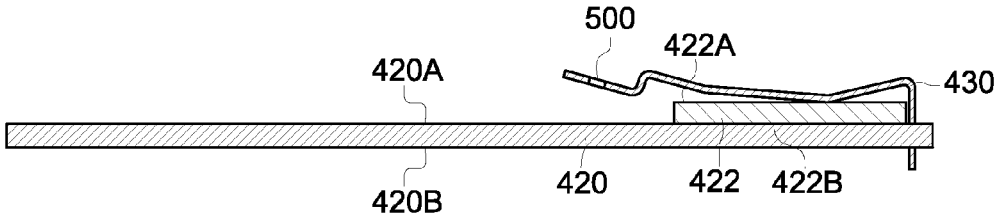
FIG. 15 is a cross-sectional schematic of an embodiment of the electrical connector and the first and second busbars of FIG. 14.

Referring to FIGS. 11 and 15, an electrical circuit 400 in accordance with an exemplary embodiment is provided. The electrical circuit 400 includes a first busbar 420 having a top surface 420A and a bottom surface 420B; a second busbar 422 having a top surface 422A and a bottom surface 422B; a third busbar 424; an electrical connector 430; and at least one fastener 432 such as a bolt, and a corresponding nut (not shown). The first busbar 420, the second busbar 422, and the third busbar 424 are each constructed of electrically conductive material for conducting electricity therethrough. In one exemplary embodiment, the first busbar 420, the second busbar 422, and the third busbar 424 are constructed of copper.

In an embodiment, the first busbar 420 is coupled at a first end to the second bus bar 422 by the electrical connector 430, and coupled at a second end to third busbar 424 via fasteners, such as bolts. In another embodiment, the first busbar 420 is coupled at a first end to third bus bar 424 by a first electrical connector 430, and coupled at a second end to first busbar 420 via a second electrical connector 430 (not shown).

In an embodiment the electrical connector 430 is configured to electrically couple the first busbar 420 extending in a first direction "X", and the second busbar 422 extending in a second direction "Y". In an embodiment, the first and second directions X, Y are substantially orthogonal. An advantage of the electrical connector 430 is that the connector 430 can be coupled to the second busbar 422 without the need to form holes in the busbar 422, such as by drilling.

Referring to FIGS. 11-13A, and in an embodiment, the electrical connector 430 includes a first mounting portion 450, a clamping portion 452, and a second mounting portion 454. The electrical connector 430 is constructed of an electrically conductive material for conducting electricity therethrough. In one exemplary embodiment, the electrical connector 430 is constructed of copper. In alternative embodiments, the electrical connector 430 may be constructed of any desired electrically conductive material suitable for a purpose disclosed herein.

Figure 13:
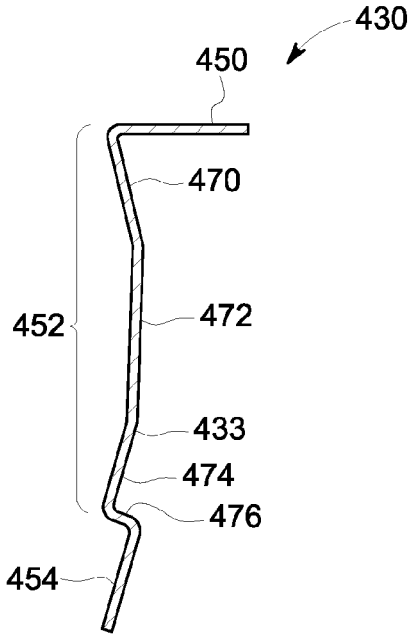
FIG. 13 is a cross-sectional schematic of an embodiment of the electrical connector of FIG. 11.
Figure 13A:
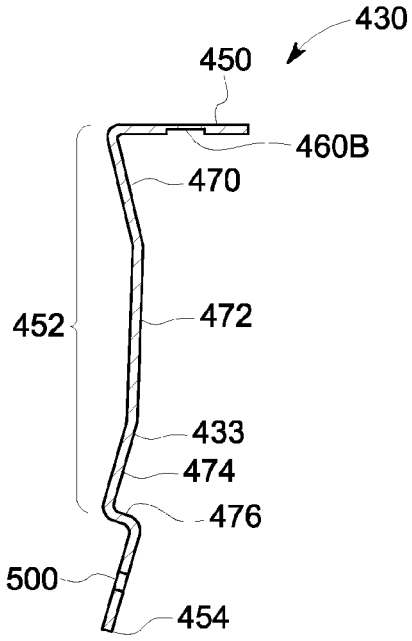
FIG. 13A is a cross-sectional schematic of an embodiment of the electrical connector of FIG. 11.

The first mounting portion 450 comprises a receiving portion 460. The receiving portion 460 is sized and disposed to receive an end portion 461 of the first busbar 420. In one embodiment, the receiving portion 460 defines a first aperture 460A extending therethrough sized and disposed to receive the end portion 461 of the first busbar 420 therethrough (FIG. 13). In another embodiment, the receiving portion 460 defines a slot 460B sized and disposed to receive the end portion 461 of the first busbar 420 therein (FIG. 13A). One advantage of an embodiment having aperture 460A is that connector 430 is adjustably positionable on at least one of first busbar 420 and second busbar 422.

The clamping portion 452 is coupled to the first mounting portion 450 and is configured and arranged to extend over a portion of the first busbar 420. The clamping portion 452 is configured to operatively impart a clamping force in a third direction indicated by arrow F, i.e., toward the second busbar 422 when the second busbar 422 is disposed between the clamping portion 452 and the first busbar 420. In an embodiment, the third direction F is substantially orthogonal to both the first and second directions. In an embodiment, the clamping portion 452 further comprises a resilient pivoting member 433 and disposed to operatively impart a clamping force in the third direction F through clamping portion 452 toward the second busbar 422 during an installation of connector 430. For example, during an installation of connector 430, a mounting force generally in the third direction F is applied by a user to the second mounting plate portion, such as through the at least one fastener 432, thereby causing a flexing or bending of resilient pivoting member 433 whereby clamping portion 452 imparts a clamping force in the third direction F.

In an embodiment, the clamping portion 452 comprises a first hinge portion 470, a first contact portion 472, a second contact portion 474, and a coupling portion 476. In an embodiment, the first hinge portion 470 extends outwardly from an end of the first mounting portion 450 at an acute angle relative to the first mounting portion 450. The first contact portion 472 is coupled to and disposed between the first hinge portion 470 and the second contact portion 474. In an embodiment, the first contact portion 472 is disposed generally perpendicular to the first mounting portion 450. The second contact portion 474 is coupled to and disposed between the first contact portion 472 and the coupling portion 476. The coupling portion 476 extends generally perpendicular to the second contact portion 474 and is coupled to the second mounting portion 454. In an embodiment, the second mounting portion 454 extends generally perpendicular to the portion 476. In an embodiment, clamping portion 452 is configured to contact the top surface 422A of the second busbar 422. In other embodiments an intermediate plate, such as a conductive shim (not shown) may be disposed between the clamping portion 452 and the second busbar 422.

The second mounting portion 454 is coupled to the clamping portion 452. The second mounting portion 454 is configured to be coupled to the first busbar 420 such that the second busbar 422 is fixedly held between the clamping portion 452 and the first busbar 420, and the second busbar 422 is electrically coupled to the first busbar 420. For example, in one embodiment, the second mounting portion 454 defines at least one second mounting portion aperture 500 extending therethrough and sized and disposed to operably align with a corresponding at least one aperture 421 defined in the first busbar 420.

In an embodiment, the at least one fastener 432, such as a bolt, is disposed to extend through the second mounting portion aperture 500 and the corresponding at least one aperture 421 defined in first busbar 420 and is coupled to a first nut 433.

Referring to FIGS. 14-18, a flowchart of a method for coupling the electrical connector 430 to the first busbar 420 and the second busbar 422 in accordance with another exemplary embodiment will now be explained.

At step 600, the user provides the electrical connector 430 having the first mounting portion 450 comprising the receiving portion 460 formed therein, the clamping portion 452 coupled to an end of the first mounting portion 450, and the second mounting portion 454 coupled to an end of the clamping portion 452. The second mounting portion 454 having at least one second mounting portion aperture 500 defined therethrough.

Figure 14:
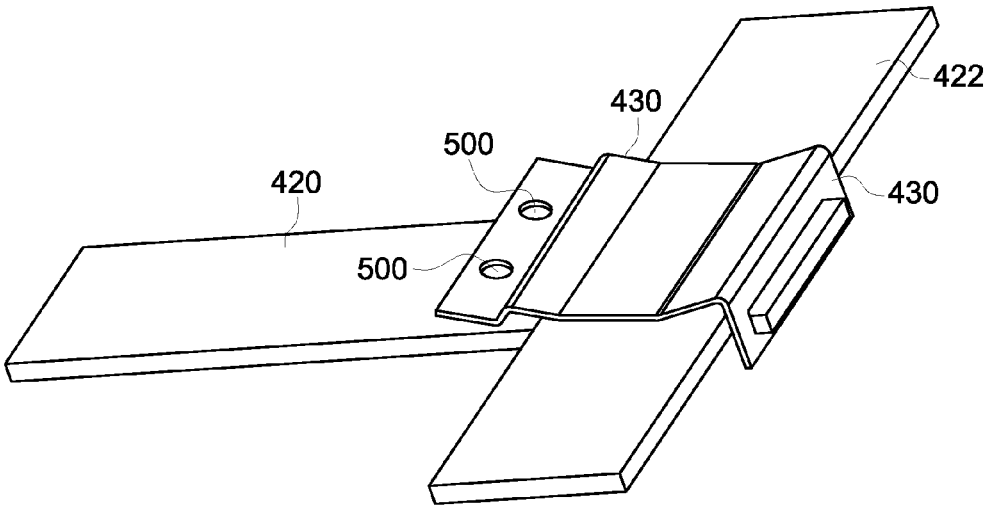
FIG. 14 is a schematic of an embodiment of the electrical connector of FIG. 11 in a flexed configuration disposed on first and second busbars.

At step 602, the user inserts an end portion 461 of the first busbar 420 into the receiving portion 460 of the first mounting portion 450 (as shown in FIGS. 14 and 15) such that the clamping portion 452 extends over a portion of the first busbar 420 extending in a first direction.

At step 604, the user disposes a second busbar 422 to extend in a second direction substantially perpendicular to the first direction, and between the clamping portion 452 and the first busbar 420 (as shown in FIGS. 14 and 15).

Figure 16:
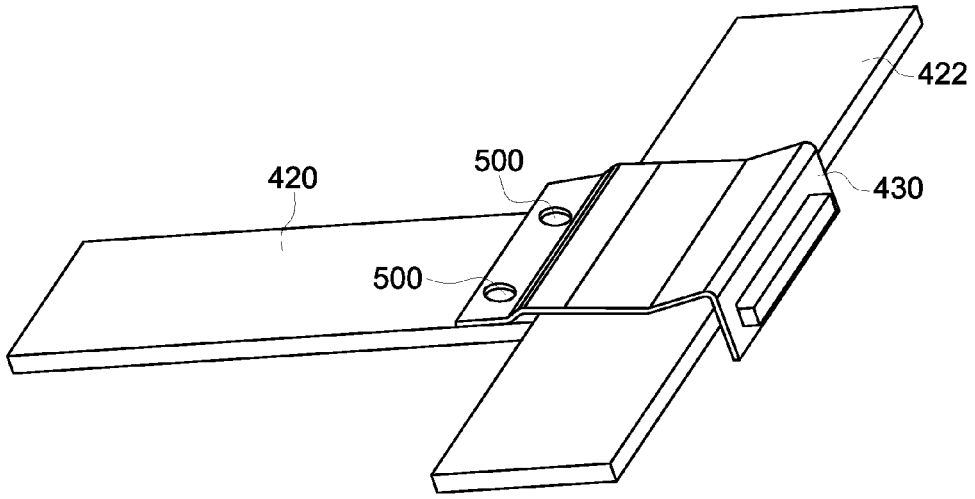
FIG. 16 is a schematic of an embodiment of the electrical connector of FIG. 11 configuration and disposed on the first and second busbars.
Figure 17:
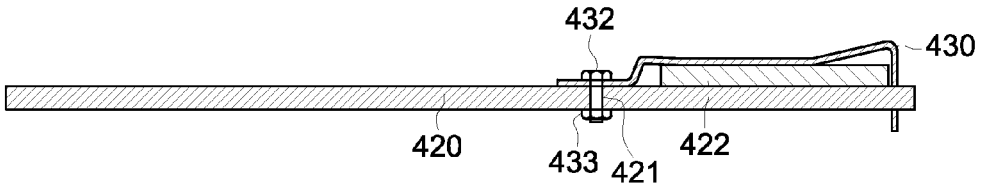
FIG. 17 is a cross-sectional schematic of the electrical connector and the first and second busbars of FIG. 16.
Figure 18:
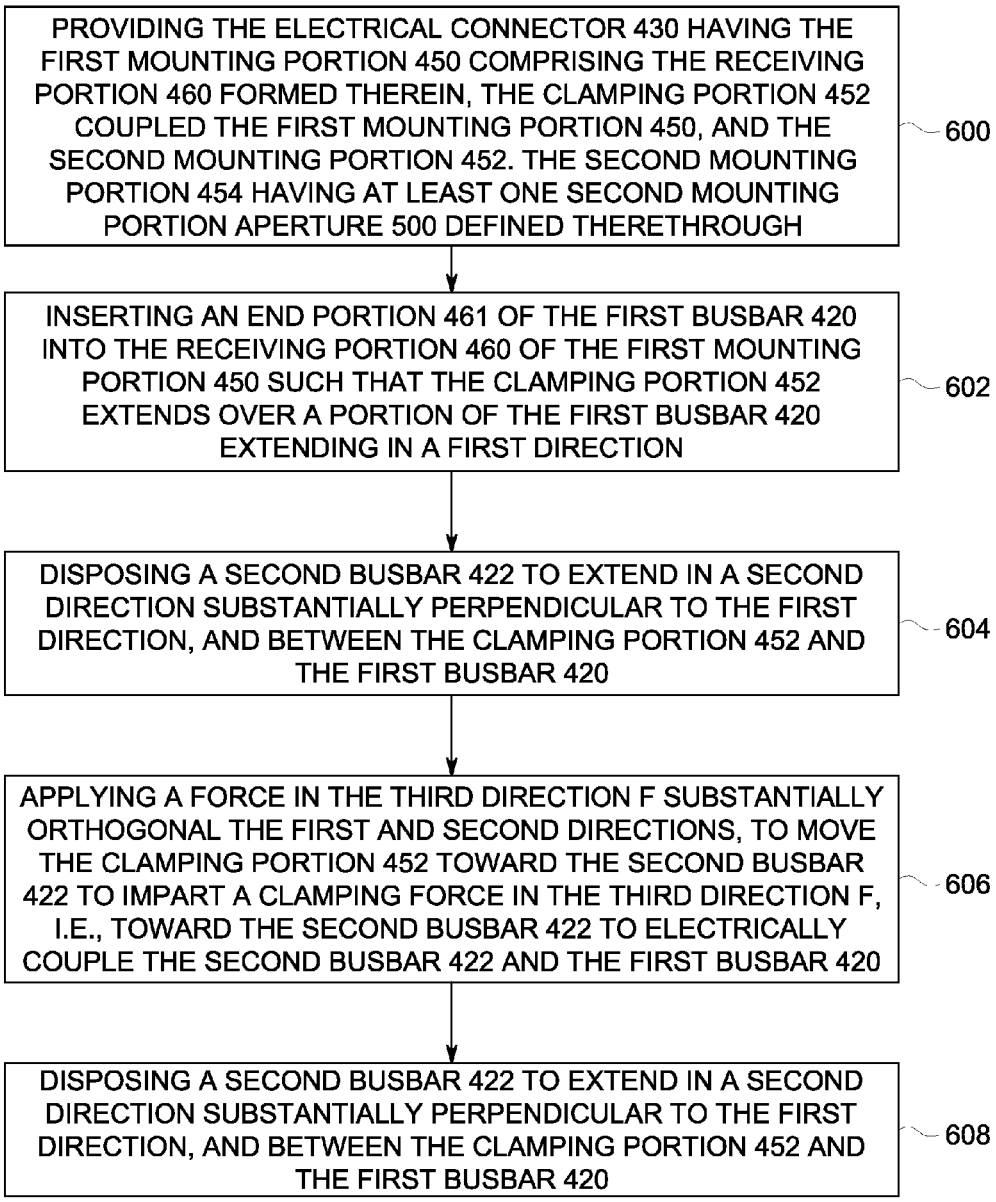
FIG. 18 is a flowchart of a method for coupling an electrical connector to first and second busbars in accordance with another exemplary embodiment.

At step 606, the user applies a force in the third direction F substantially orthogonal the first and second directions, to move the clamping portion 452 toward the second busbar 422 (as shown in FIGS. 16 and 17) such that clamping portion 452 imparts a clamping force in the third direction F, i.e., toward the second busbar 422 to electrically couple the second busbar 422 and the first busbar 420.

At step 608, the user fastens the connector 430 to the first busbar 420 by disposing a portion of the bolt 432 through the at least one second mounting portion aperture 500 and through an corresponding aperture of the first busbar 420 and coupling a threaded end of the bolt 432 to a first nut.

Embodiments of the electrical connectors and methods for coupling the connectors to busbars described herein provide a substantial advantage over prior art electrical connectors and methods. In particular, the electrical connectors couple together two busbars without having to drill holes in both busbars.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We Claim:

1. An electrical connector, comprising:

a first mounting portion;

a first clamping portion coupled to the first mounting portion, the first clamping portion having a first coupling tab and a second coupling tab;

the first coupling tab extending from the first mounting portion in a first direction, the first coupling tab having first and second apertures extending therethrough;

the second coupling tab extending from the first mounting portion in the first direction, the first and second coupling tabs defining a first gap, the second coupling tab having third and fourth apertures extending therethrough, the third and fourth apertures being aligned with the first and second apertures, respectively;

the first and third apertures configured to receive a first fastener;

the second and fourth apertures configured to receive a second fastener;

the first gap being sized to clamp a first busbar between the first coupling tab and the second coupling tab, the first busbar disposed between the first fastener and the second fastener;

the first and second coupling tabs being configured to form an electrical connection with the first busbar in the first gap;

a second mounting portion;

a second clamping portion coupled to the second mounting portion, the second clamping portion having a third coupling tab and a fourth coupling tab;

the third coupling tab extending from the second mounting portion in a second direction opposite to the first direction, the third coupling tab having fifth and sixth apertures extending therethrough;

the fourth coupling tab extending from the second mounting portion in the second direction, the third and fourth coupling tabs defining a second gap, the fourth coupling tab having seventh and eighth apertures extending therethrough, the seventh and eighth apertures being aligned with the fifth and sixth apertures, respectively;

the fifth and seventh apertures configured to receive a third fastener;

the sixth and eighth apertures configured to receive a fourth fastener;

the second gap is sized to receive a second busbar;

the third and fourth coupling tabs being configured to form an electrical connection with the second bus bar in the second gap.

2. The electrical connector of claim 1, wherein the first and second fasteners are configured to extend between the first coupling tab and the second coupling tab.

3. The electrical connector of claim 2, wherein the first and second fasteners are first and second bolts, respectively.

4. The electrical connector of claim 1, wherein the first mounting portion and the first and second coupling tabs are constructed of an electrically conductive material.

5. The electrical connector of claim 4, wherein the electrically conductive material is copper.

6. The electrical connector of claim 1, wherein the first mounting portion is block-shaped.

7. The electrical connector of claim 1, wherein the first and second coupling tabs have first and second grooves, respectively, disposed proximate to the first mounting portion, wherein the first and second coupling tabs are bendable proximate the first and second grooves, respectively, toward one another.

8. The electrical connector of claim 1, wherein the third and fourth fasteners are configured to extend between the first coupling tab and the second coupling tab.

9. The electrical connector of claim 8, wherein the third and fourth fasteners are first and second bolts, respectively.

10. The electrical connector of claim 1, wherein the second mounting portion and the third and fourth coupling tabs are constructed of an electrically conductive material.

11. The electrical connector of claim 1, wherein the second mounting portion is block-shaped.

12. The electrical connector of claim 1, wherein the third and fourth coupling tabs have first and second grooves, respectively, disposed proximate to the second mounting portion, wherein the third and fourth coupling tabs are bendable proximate the first and second grooves, respectively, toward one another.

* * * * *

UNITED STATES PATENT AND TRADEMARK OFFICE

CERTIFICATE OF CORRECTION

PATENT NO. : 8,690,612 B2
APPLICATION NO. : 13/430335
DATED : April 8, 2014
INVENTOR(S) : Tomanek et al.

It is certified that error appears in the above-identified patent and that said Letters Patent is hereby corrected as shown below:

On the Title Page, in item (75), under "Inventors:", in Column 1, Line 2, delete "Ooost" and insert -- Oost --, therefor.

In the Drawings

In Fig. 9, Sheet 6 of 18, for Tag "350", in Line 10, delete "TAPS," and insert -- TABS, --, therefor.

In the Specification

In Column 6, Line 19, delete "portion 760" and insert -- portion 726 --, therefor.

Signed and Sealed this
Ninth Day of September, 2014

Michelle K. Lee

Michelle K. Lee
*Deputy Director of the United States Patent and Trademark Office*